US008713749B2

(12) United States Patent
Ruiz et al.

(10) Patent No.: US 8,713,749 B2
(45) Date of Patent: May 6, 2014

(54) EXTRACTOR TOOL FOR A WET/DRY VACUUM

(75) Inventors: Marco Antonio Cortes Ruiz, Cuautitlan Izcalli (MX); Felix Rodriguez Perfino, Cuautitlan Izcalli (MX); Richard Arthur Kohler, Cuautitlan Izcalli (MX)

(73) Assignee: Koblenz Electrica S.A. de C.V., Cuautitlan Izcalli (MX)

( * ) Notice: Subject to any disclaimer, the term of this patent is extended or adjusted under 35 U.S.C. 154(b) by 215 days.

(21) Appl. No.: 13/184,735

(22) Filed: Jul. 18, 2011

(65) Prior Publication Data

US 2013/0019430 A1 Jan. 24, 2013

(51) Int. Cl.
*A47L 9/02* (2006.01)

(52) U.S. Cl.
USPC ..... 15/320; 15/322; 15/414

(58) Field of Classification Search
USPC ..... 15/320, 321, 322, 328, 414
See application file for complete search history.

(56) References Cited

U.S. PATENT DOCUMENTS

| | | | | | |
|---|---|---|---|---|---|
| 2,270,579 | A * | 1/1942 | Chamberlin et al. | ..... | 15/321 |
| 3,883,301 | A * | 5/1975 | Emrick et al. | ..... | 8/158 |
| 4,019,218 | A * | 4/1977 | Cyphert | ..... | 15/321 |
| 4,138,760 | A | 2/1979 | Cadle | | |
| 4,333,203 | A | 6/1982 | Yonkers | | |
| 4,845,802 | A | 7/1989 | Miller et al. | | |
| 4,887,330 | A * | 12/1989 | Woodhall et al. | ..... | 15/322 |
| 4,910,828 | A * | 3/1990 | Blase et al. | ..... | 15/321 |
| 5,001,806 | A * | 3/1991 | Gurstein | ..... | 15/322 |
| 5,088,149 | A | 2/1992 | Berg et al. | | |
| 5,311,638 | A * | 5/1994 | Furcron et al. | ..... | 15/321 |
| 5,555,597 | A | 9/1996 | Berfield | | |
| 5,600,866 | A | 2/1997 | Berfield | | |
| 5,613,271 | A * | 3/1997 | Thomas | ..... | 15/321 |
| 5,752,289 | A * | 5/1998 | Collins | ..... | 15/421 |
| 7,188,387 | B2 | 3/2007 | Dicioccio | | |
| 7,475,448 | B2 * | 1/2009 | Rosenzweig et al. | ..... | 15/320 |
| 2004/0177469 | A1 * | 9/2004 | Sadaune et al. | ..... | 15/322 |
| 2006/0272120 | A1 * | 12/2006 | Barrick et al. | ..... | 15/321 |

* cited by examiner

*Primary Examiner* — Mark Spisich
*Assistant Examiner* — Andrew A Horton
(74) *Attorney, Agent, or Firm* — Greenberg Traurig, LLP

(57) ABSTRACT

A cleaner spotter tool for a wet/dry vacuum cleaner having a fluid containing tank, an extractor nozzle housing coupled to the tank, a fluid delivery pump mounted in the nozzle housing, a tubing fluidly coupled to both the tank and the pump for delivering fluid from the tank to the pump, and a spray nozzle on the nozzle housing coupled to the pump for spraying fluid out of the pump.

10 Claims, 10 Drawing Sheets

EXTRACTOR TOOL FOR A WET/DRY VACUUM

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A SEQUENCE LISTING

Not Applicable

BACKGROUND OF THE INVENTION

1. Technical Field

The invention relates to wet/dry vacuum cleaners, and, more particularly, to an tool which converts any wet/dry vacuum cleaner to a small carpet extractor or spotter.

Cross-Reference to Related Applications

Not applicable.

2. Background Art

Wet/dry vacuums are well known in the art for cleaning floors and fabrics such as carpets and upholsteries. Such vacuum cleaners generally include a portable recovery tank having a vacuum pump and a vacuum head connected via a wand and hose to the tank for sucking wet and/or dry material from the surface being cleaned into the tank.

There is a need for an extractor tool that can convert any wet/dry vacuum to a small carpet extractor or spotter extractor machine that can clean small spots and soil easily by scrubbing and vacuuming as an extractor machine.

BRIEF SUMMARY OF THE INVENTION

Summary

These and other objects are preferably accomplished by providing a tool that contains a bottle or container for containing therein a liquid cleaning solution, and an integrated pump communicating with the liquid cleaning solution in the bottle or container and a brush for dispensing the cleaning solution to clean a small spot or soil on a carpet or the like.

BRIEF DESCRIPTION OF THE SEVERAL VIEW OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION OF THE INVENTION

Figure 1:
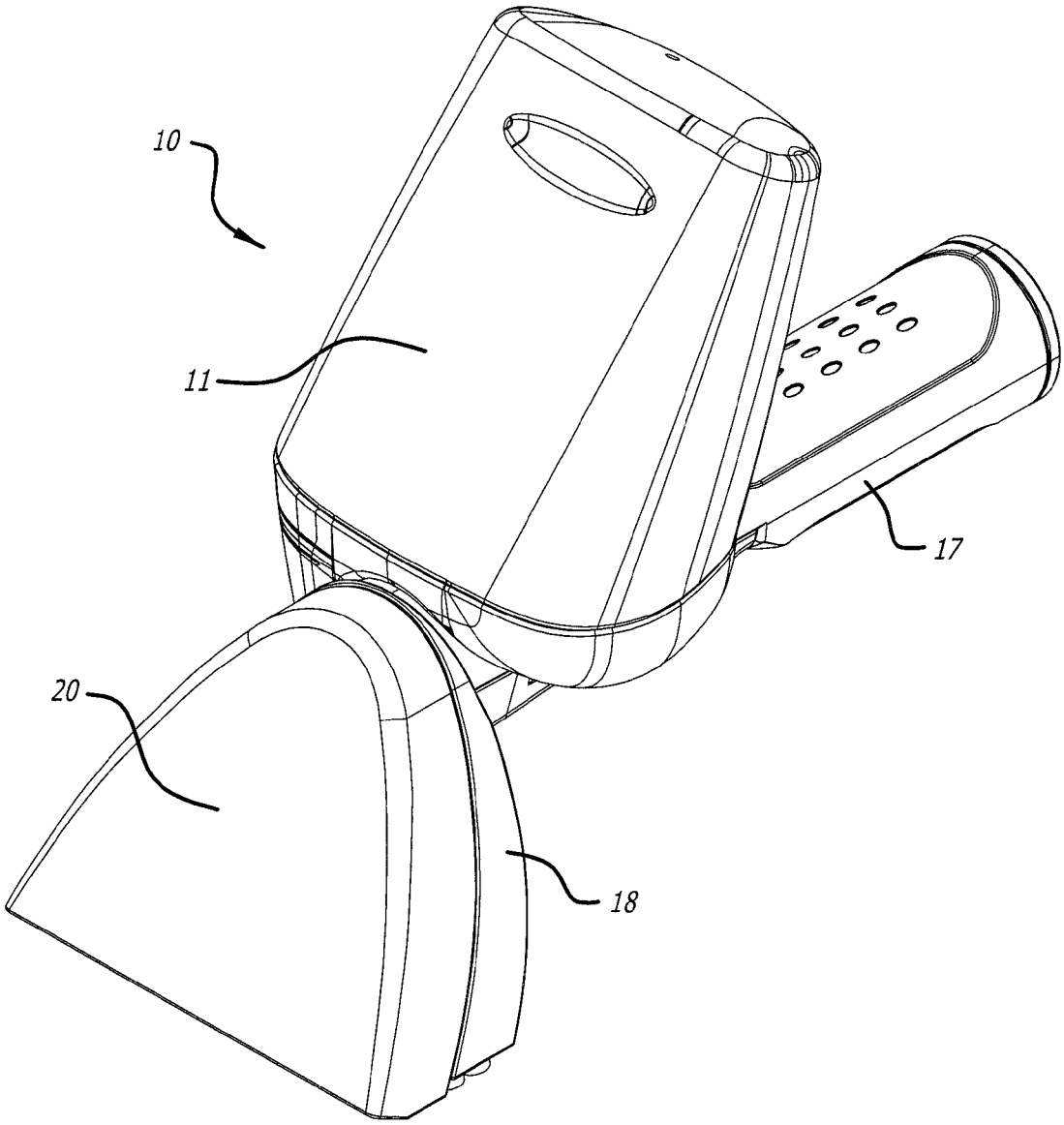
FIG. 1 is a overall perspective view of the tool of the invention removed from the vacuum.

Referring now to FIG. 1 of the drawing, an extractor tool 10 in accordance with the teachings of the invention is shown. Tool 10 has a liquid holding container 11, a connection tube 17 extending from an extractor housing 18, for connecting tool 10 to a conventional wet/dry vacuum cleaner 100 (see FIG. 2). A cover 20 closes off the front of extractor nozzle or housing 18.

Figure 3:
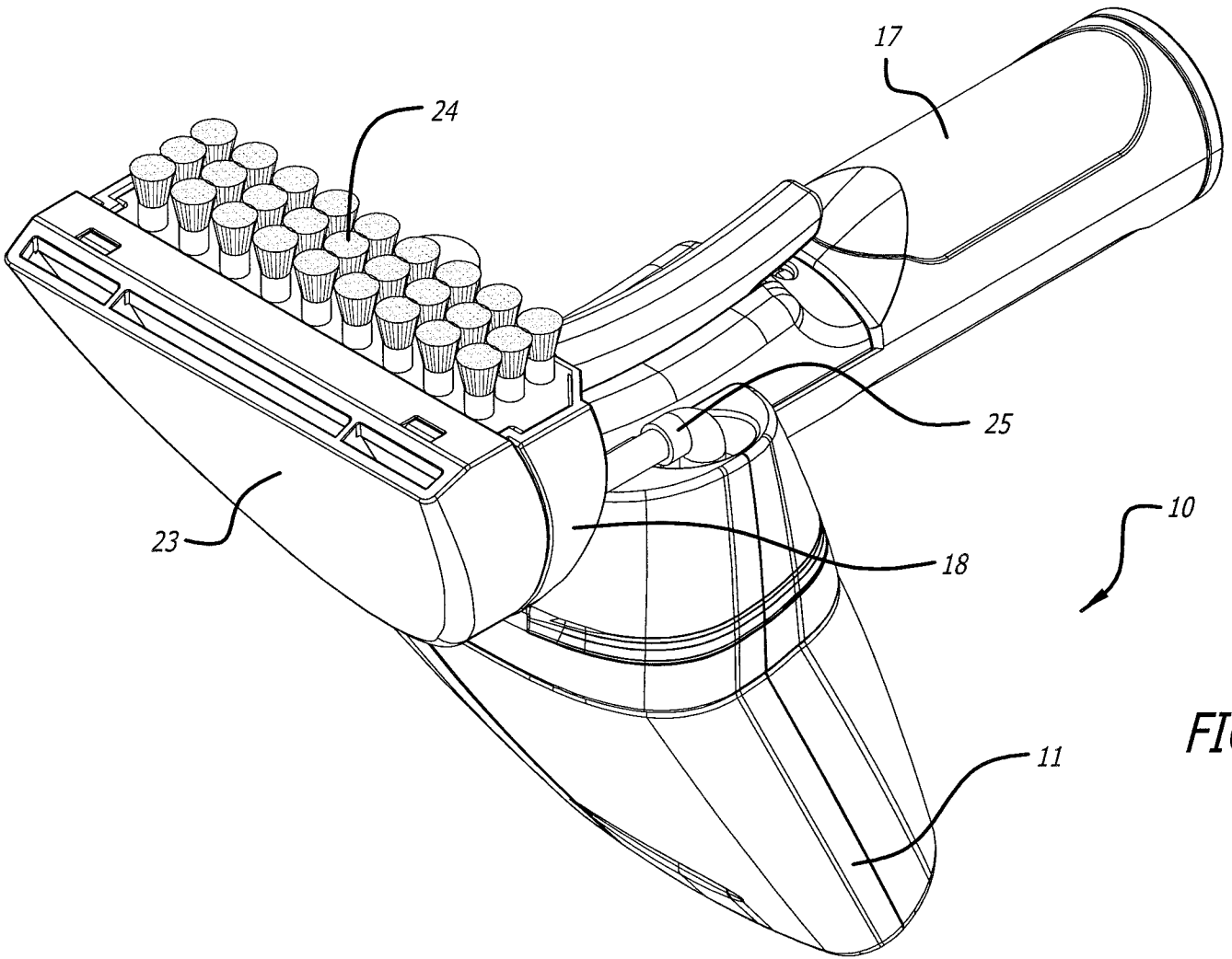
FIG. 3 is a bottom perspective view from the front of the tool alone of FIG. 1.

FIG. 3 is a bottom perspective view of the tool 10 of FIG. 1. A brush assembly 23 is shown having a plurality of downwardly extending bristles 24 is connected to extractor nozzle 18. Fluid is supplied to nozzle 18 from tube 25 in fluid communication with container 11 as will be discussed further herein below.

Figure 4:
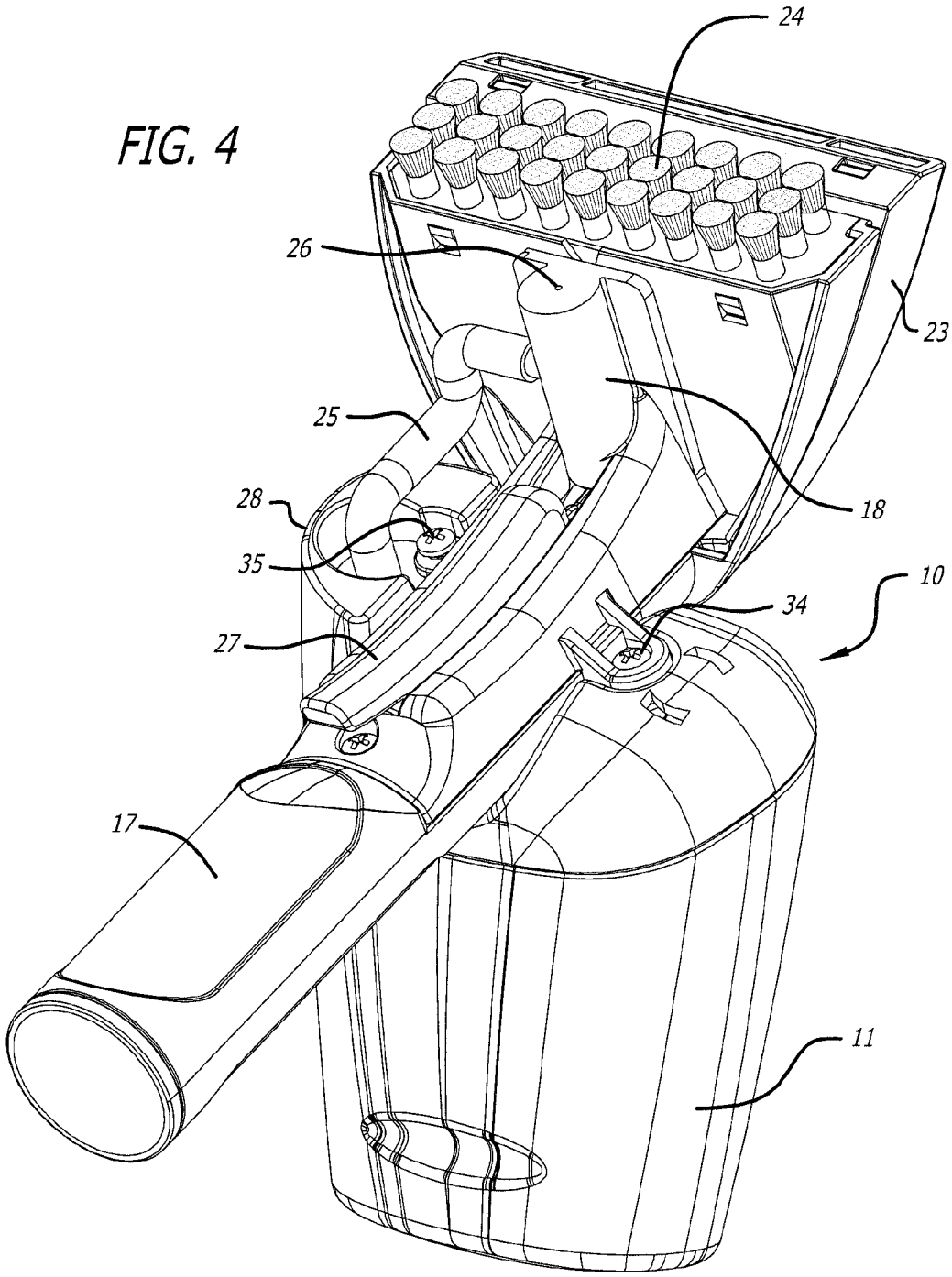
FIG. 4 is a new similar to the view of FIG. 1 taken 180° from the view of FIG. 3.
Figure 5:
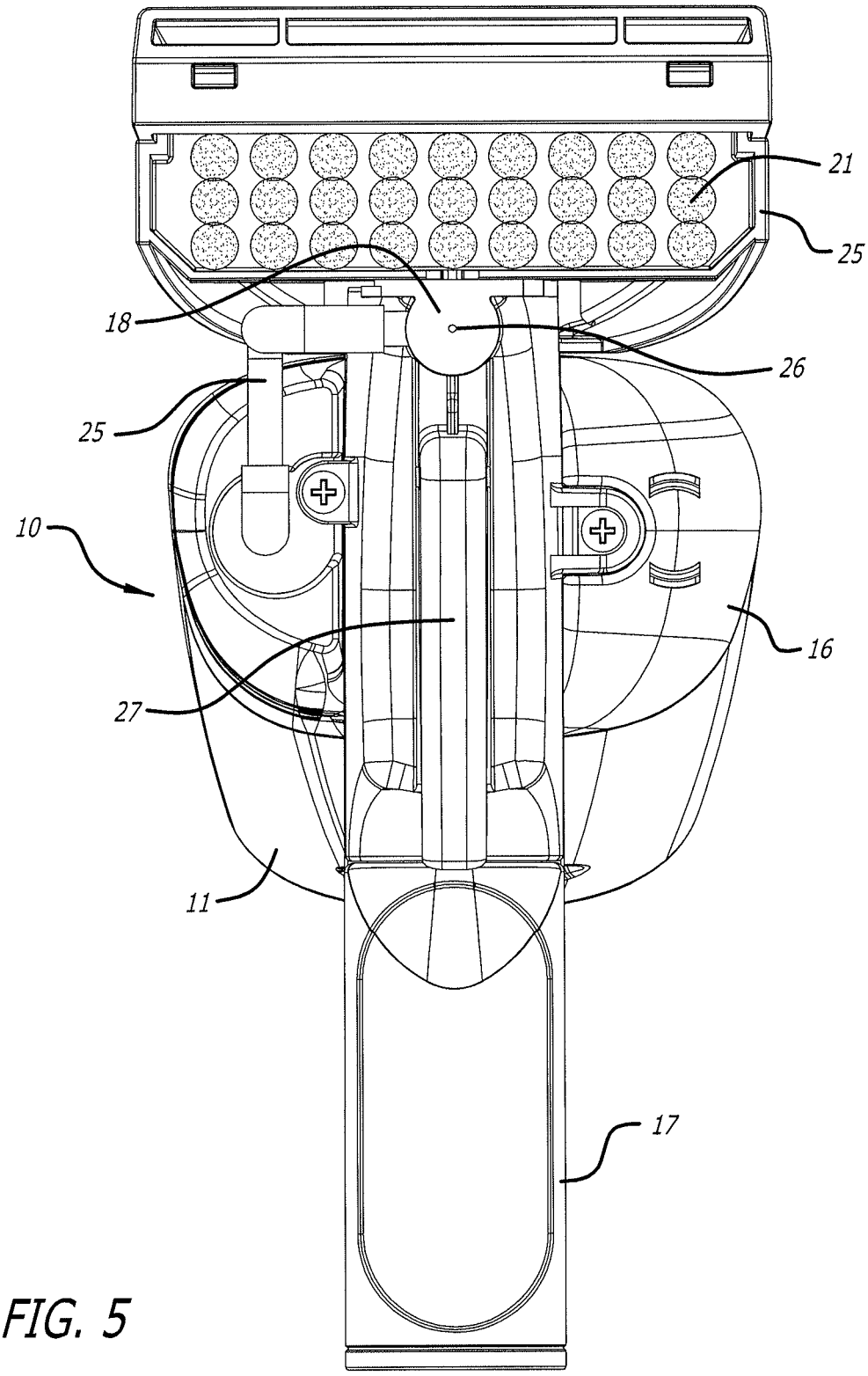
FIG. 5 is a bottom plan view of the tool alone of FIG. 1.

FIG. 4 is a view of tool 10 similar to that in FIG. 3 but to further illustrate the connection of tube 25 to the extractor nozzle 18. The nozzle outlet or orifice 26 communicates with the interior of the extractor nozzle 18 as shown in FIGS. 4 and 5. Also shown in FIGS. 4 and 5 is the trigger assembly 27 for actuating distribution of fluid from tank 11, through tube 25 and out of orifice 26, as will be discussed further herein below.

Figure 6:
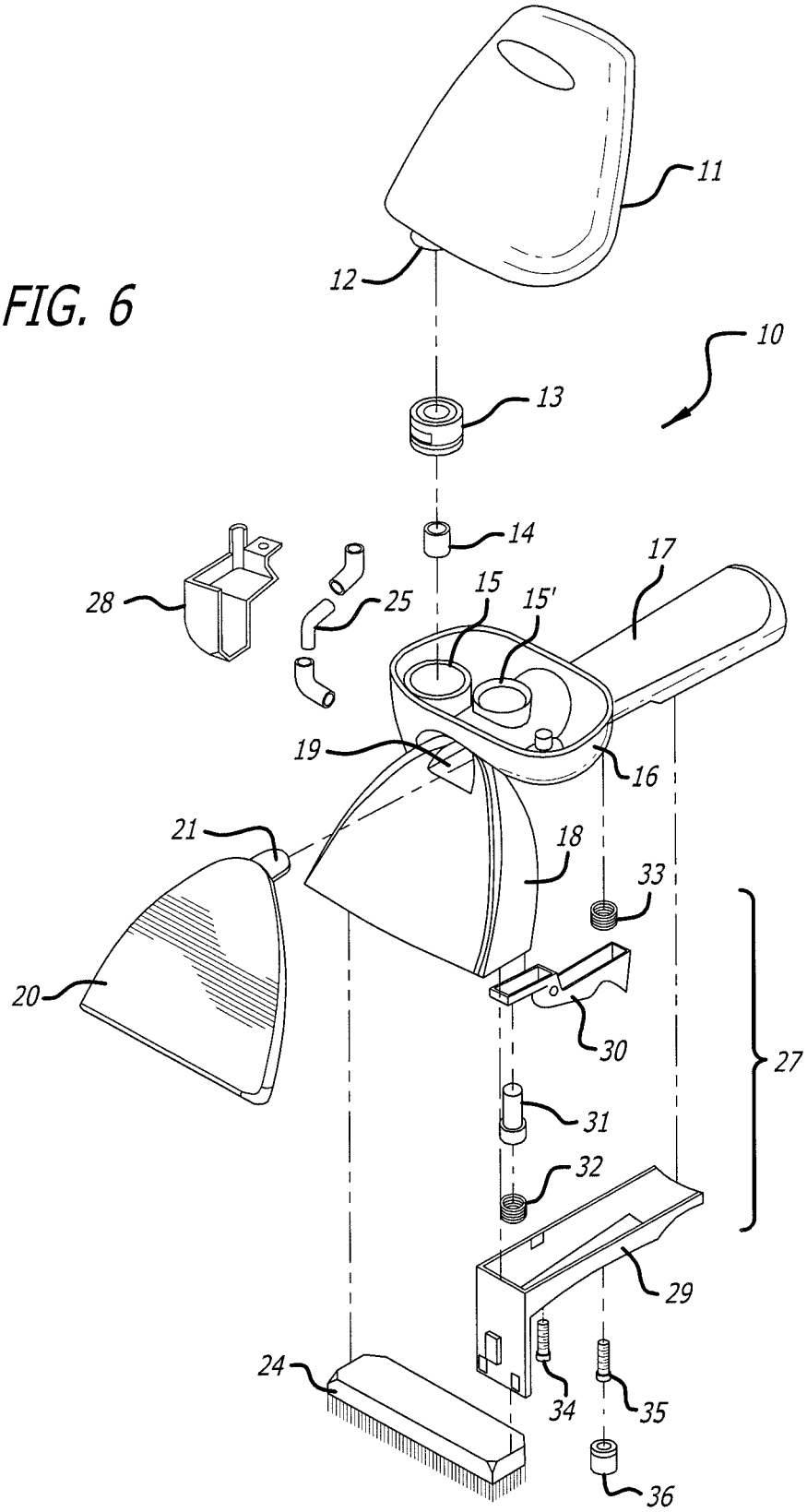
FIG. 6 is an exploded view of the tool alone of FIG. 1.

An exploded view of tool 10 is shown in FIG. 6. Extractor tool 10 has a container 11 adapted to hold a liquid cleaning solution therein with a neck 12. A bottle cap 13 press fits onto neck 12. A check valve 14 is inserted into cap 13 and cap 13 is pressfit into a mating cavity or hole 15 in tank support housing 16. Boss 15' is provided in housing 16 for alignment of container 11 in housing 16. A connection tube 17 extends outwardly from housing 16 and extractor nozzle 18 extends downwardly from housing 16 in fluid communication with liquid from container 11, when assembled with tab opening 19 adapted to receive therein tab 21, and is normally covered by front cover 20, tab 21 extending into opening 19.

A cover 28 is shown for covering hose 25 (see also FIG. 4), Trigger assembly 27 (FIG. 6) includes a trigger housing 29, a trigger 30 receivable in housing 29, a plunger 31 and a coiled spring 32. A second coiled spring 33 is provided in trigger assembly 27. Threaded screws 34, 35 are provided for assembly of the trigger assembly 27 to suitable aligned holes in the extractor nozzle 18. (see FIG. 4).

Figure 8:
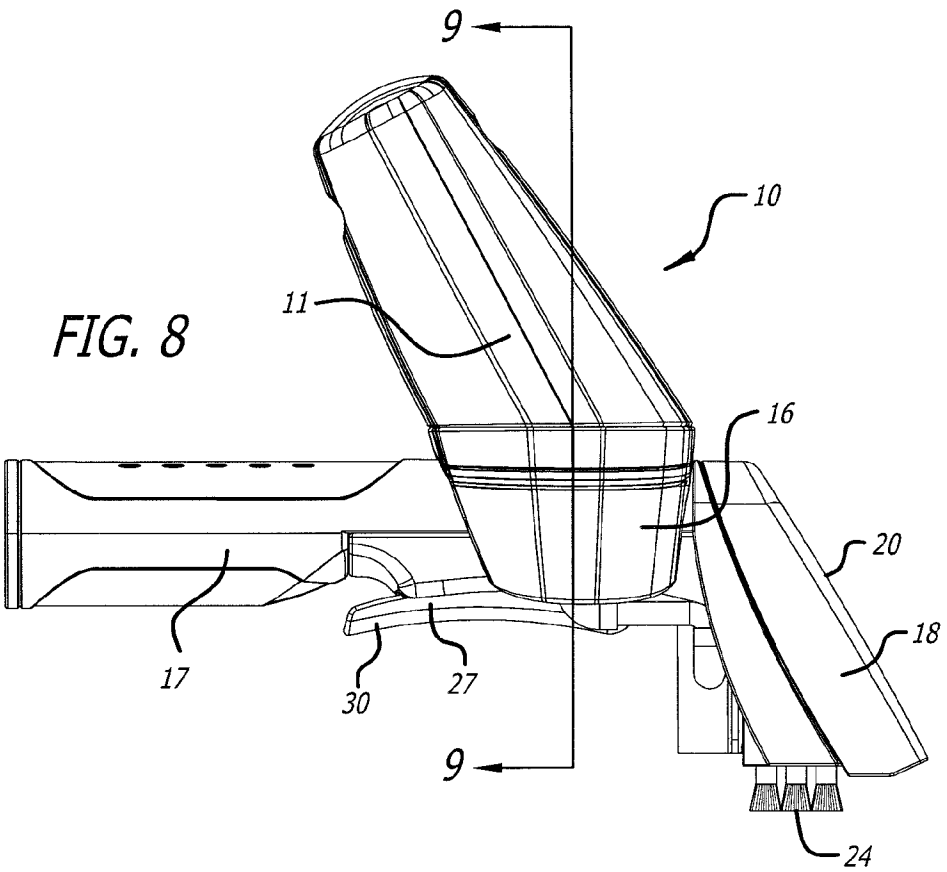
FIG. 8 is a right side elevational view of the tool of FIG. 1.
Figure 7:
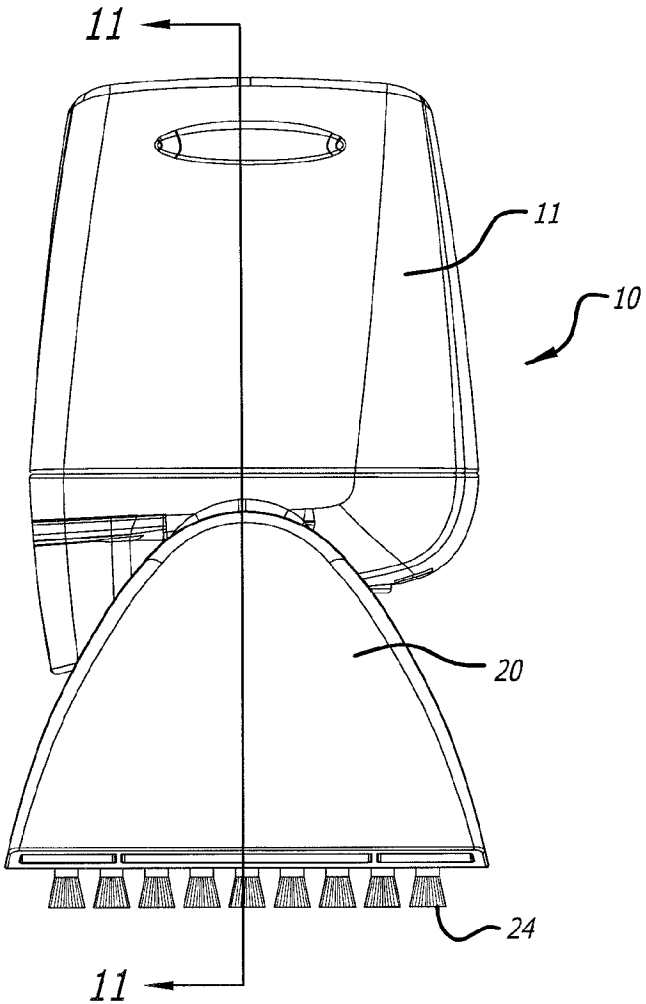
FIG. 7 is a front elevational view of the tool of FIG. 1.

A one way valve 36 is provided for the nozzle 18 as will be discussed. The front view of tool 10 is shown in FIG. 7. As seen in FIG. 8, the operating position of tool 10 is shown with the trigger 30 shown in operative position.

Figure 10:
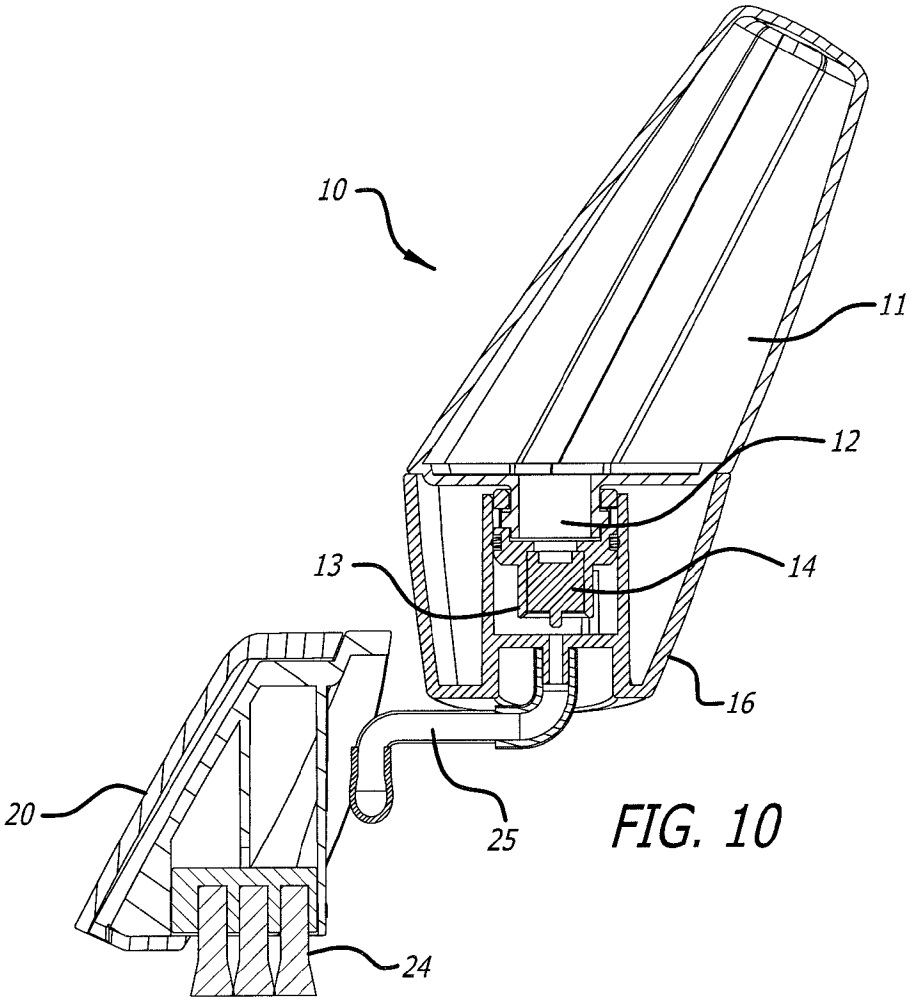
FIG. 10 is a view taken along line 10-10 of FIG. 9.
Figure 9:
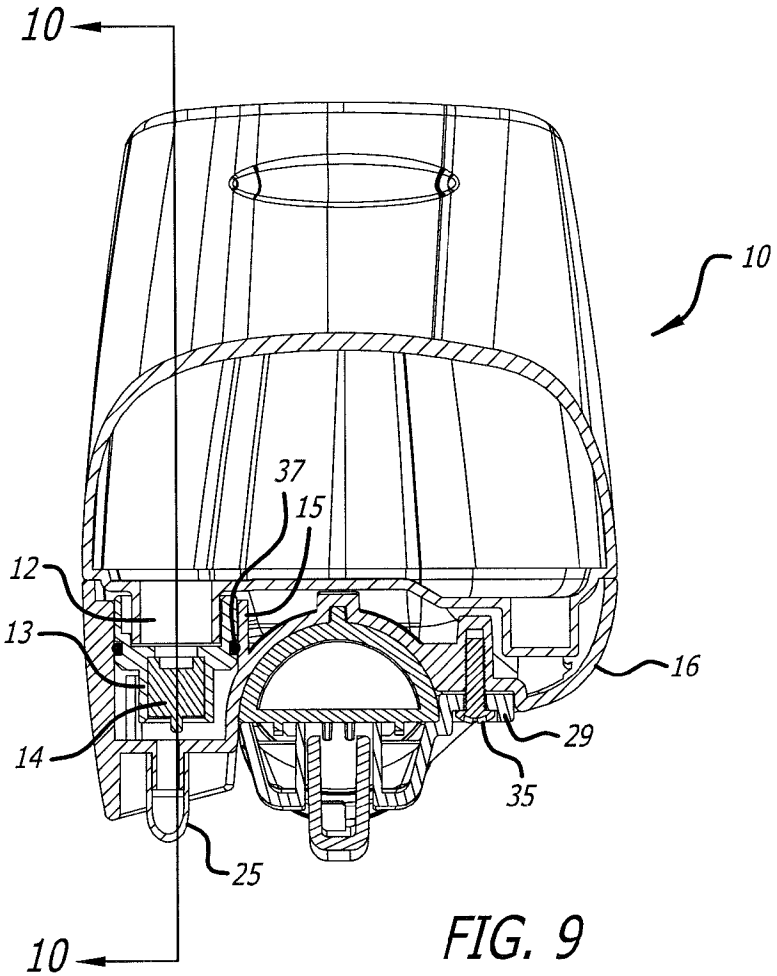
FIG. 9 is a view taken along line 9-9 of FIG. 8.

As seen in FIG. 4, tube 25 comes out of the bottom of the tank housing support 16 and enters the extractor nozzle 18. As seen in FIGS. 9 and 10, hose 25 is in fluid communication with tank support housing 16. Check valve 14 is disposed in cap 13 reciprocal in hole or cavity 15 with O-ring 37 mounted in a groove in cap 13. Fluid from container 11 thus enters tube 25 and out orifice 26 (see FIG. 11).

Figure 12:
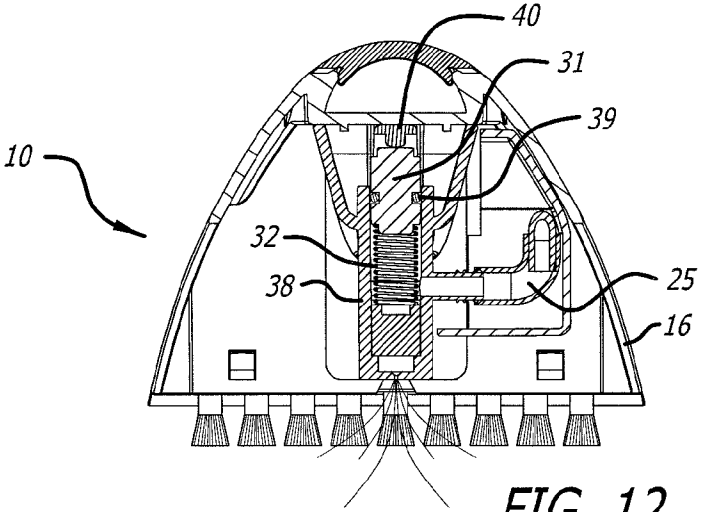
FIG. 12 is a view taken along line 12-12 of FIG. 11.
Figure 11:
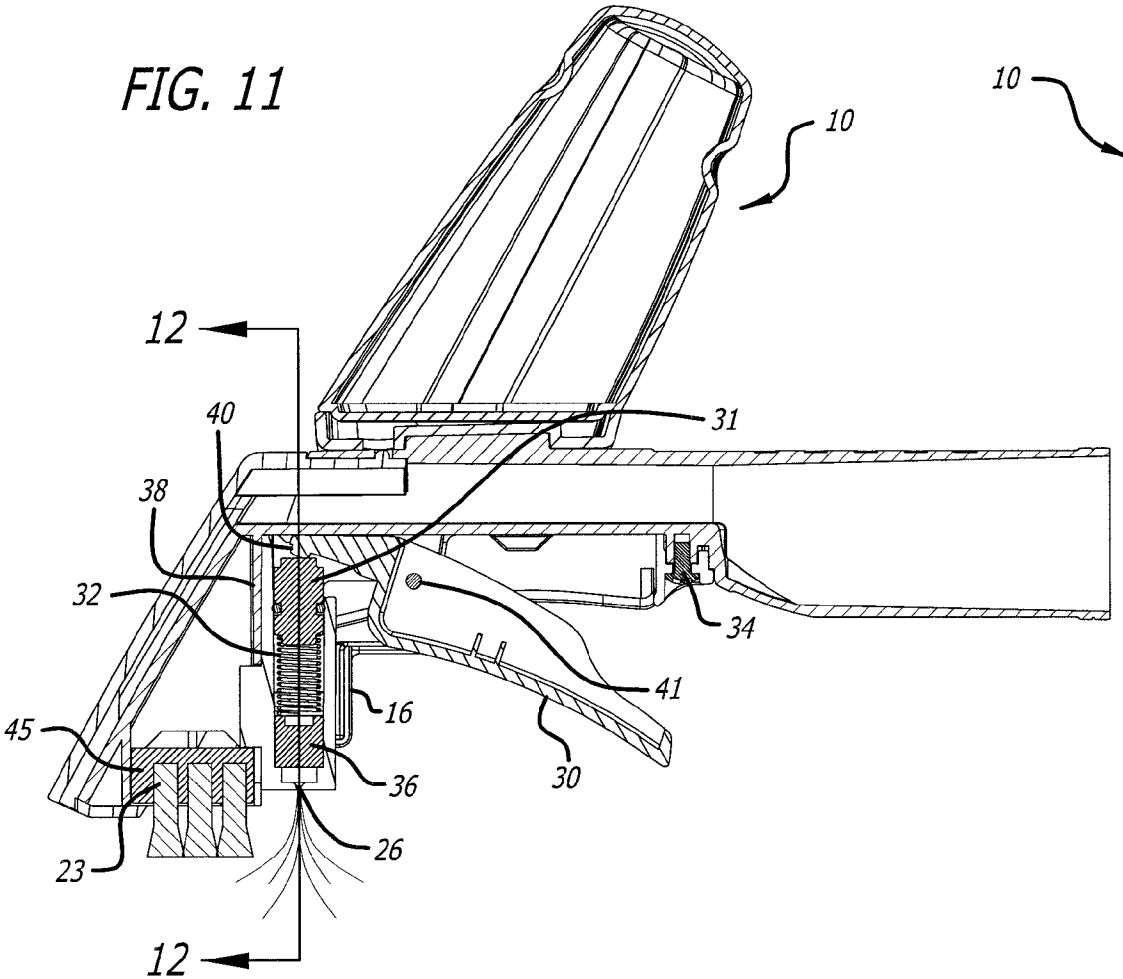
FIG. 11 is a view taken along line 11-11 of FIG. 7.
Figure 14:
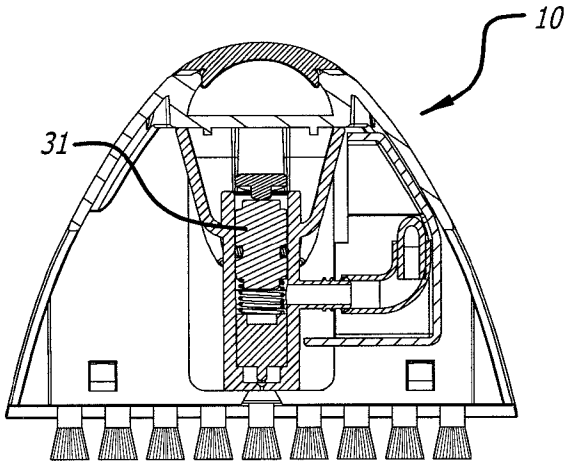
FIG. 14 is a view taken along line 14-14 of FIG. 13.
Figure 13:
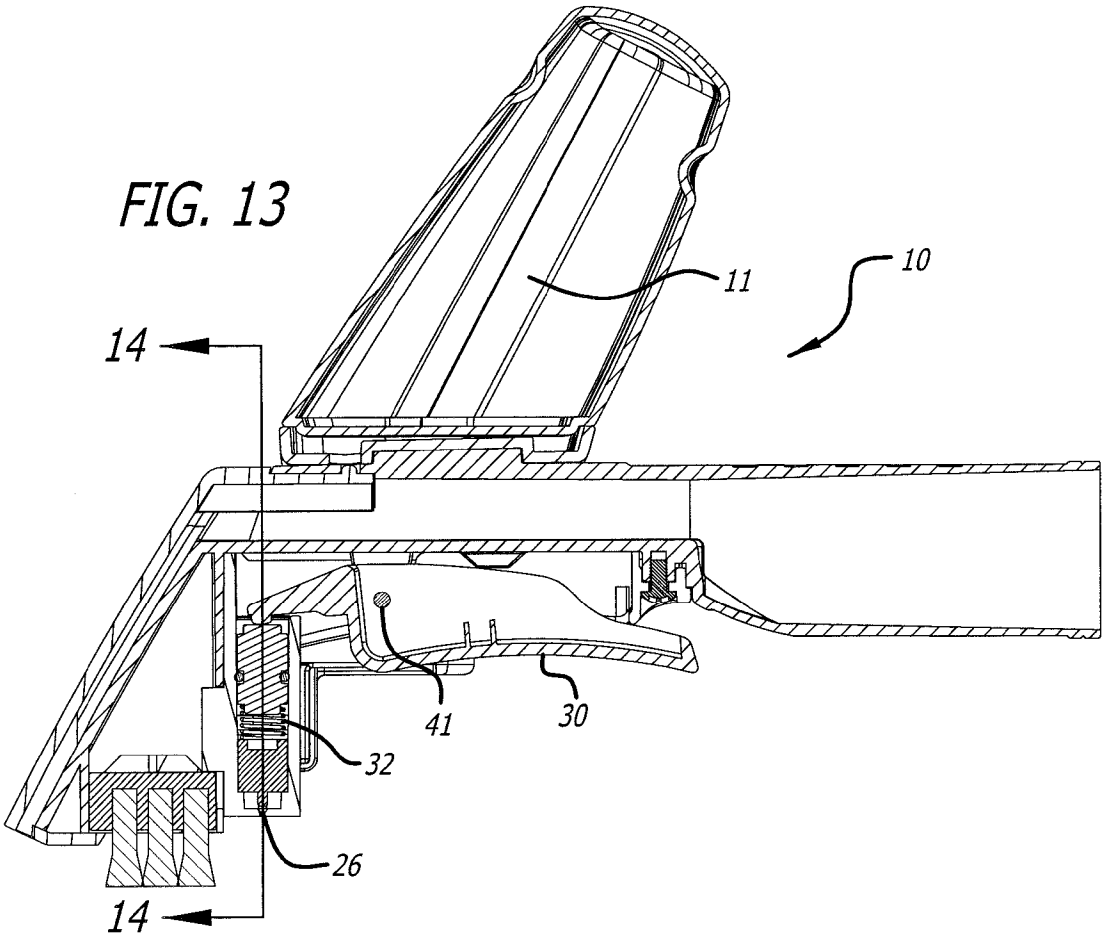
FIG. 13 is a view similar to FIG. 11 with the trigger depressed.

Thus, as seen in FIG. 11, the fluid from tube 25 (see also FIG. 12) enters into the spring chamber 38 inside of tank support housing 16. Plunger 31 is reciprocal within chamber 38 having an o-ring 39 (FIG. 12) mounted in a groove in plunger 31, spring 32 biasing plunger 31 normally upwardly written chamber 39. As seen in FIG. 11, trigger 30 has a trigger portion 40 abutting against the top of plunger 31, trigger 30 rotating about pivot pin 41. By squeezing trigger 30, spring 32 is compressed (see FIGS. 13 and 14) and thus this action acts as a pump to spray fluid out of orifice 26. Release of trigger 30 returns the plunger 31 back to the position shown in FIGS. 11 and 12.

Thus, in operation, squeezing trigger 30 sprays fluid out of nozzle 26 (see also FIG. 5) which opens rearwardly of bristles 24. A plurality of spaced vacuum slots suck up dirt and debris from the surface being cleaned up though connection tube 17 to the vacuum 100 (FIG. 2).

Figure 2:
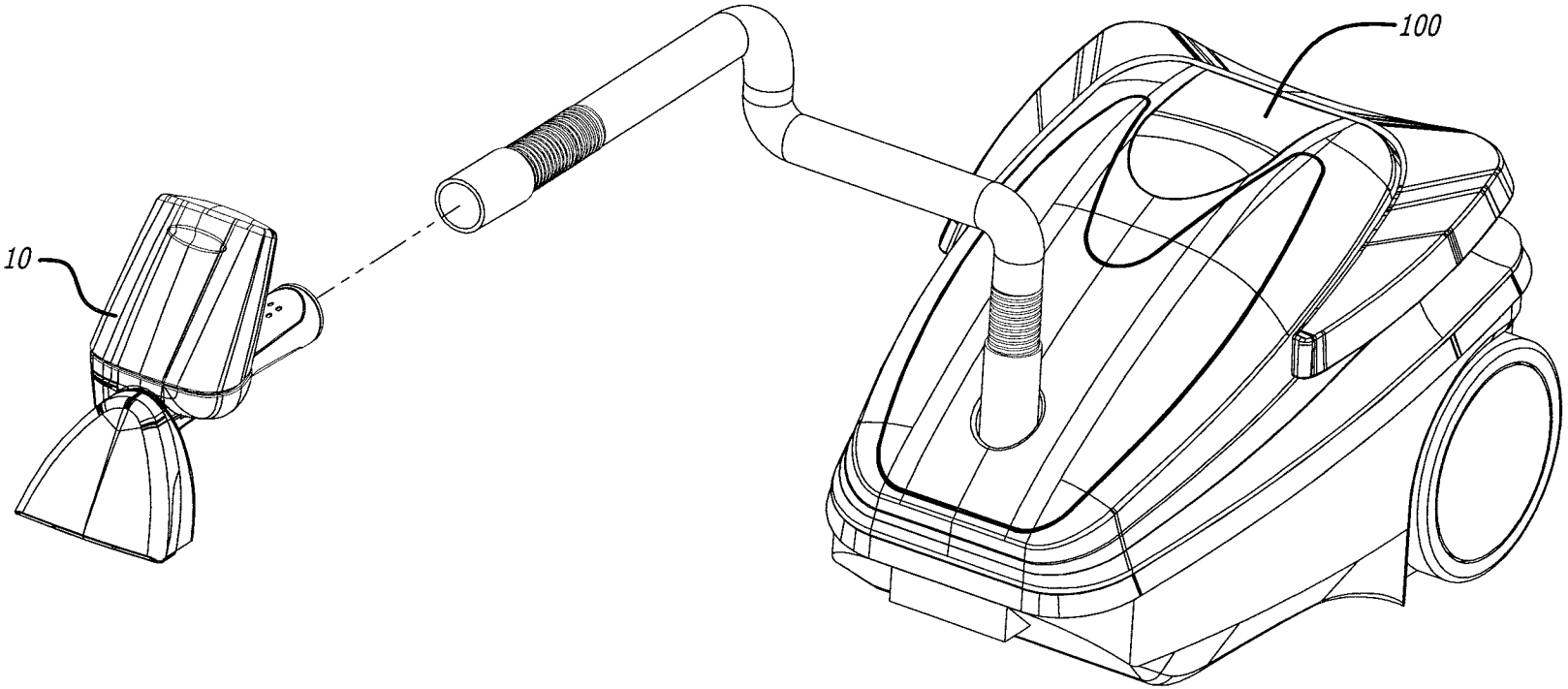
FIG. 2 is an exploded view of the tool of FIG. 1 as to be attached to a conventional vacuum.

In conclusion, tool 10 has a support housing 16 having tube 17 which connects the tool 10 to a conventional wet/dry vacuum cleaner 100 (FIG. 2). On the front of tool 10, extractor nozzle 18 is normally covered by cover 20. Housing 16 has a cavity 15 to receive bottle cap 13 with a secondary cavity 15' to align the container 11.

Trigger support housing 29 has an integrated cylinder chamber 38 containing the plunger 31 and spring 32 forming a pump. The extractor nozzle 18 has a brush holder support 45 (FIG. 11) for brush 24. Hose 25 connects cavity 15 and chamber 38 using the exhaust and outlet connection.

Trigger 30 is assembled to the tool extractor nozzle 18 engaging plunger 31 to work as a pump to spray the soap solution from container 11. Trigger 30 is fixed to nozzle 18 by pivot pin 41. Screws 34, 35 extend through suitable aligned holes in trigger housing 29 to secure the same to the nozzle 18.

When trigger 30 is activated against the bias of spring 32, soap solution is sprayed out of nozzle 26 by pushing plunger 31 downwardly. The solution in chamber 39 is pressurized, and sprayed out of nozzle 26. One way check valve 36 in chamber 38 prevents air from going into chamber 39 when the plunger 31 returns to its initial position.

There is also a one-way check valve 14 in cap 13 to prevent leakage from the container 11 when the cap 13 is in the down position. This also prevents soap solution from returning into container 11 when plunger 31 pressurizes the solution.

Thus, connecting tool 10 to a conventional wet/dry vacuum cleaner and activating trigger 30, allows one to spray the surface to be cleaned, such as a carpet, then scrub the carpet with bristles 24 until the spots on the carpet disappear. The tool 10 can be tilted to vacuum up excessive dirt soap solution. The moist carpet or upholstery will dry in a few hours.

Although a particular embodiment of the invention is disclosed, variations thereof may occur to an artisan and the scope of the invention should only be limited by the scope of the appended claims.

The invention claimed is:

1. A spotter tool for attachment to a conventional wet/dry vacuum cleaner comprising:

a container adapted to contain a liquid therein having a neck in fluid communication with the interior of the container;

a support housing having a connection tube adapted to be connected to a vacuum cleaner and a cavity in said housing receiving a bottle cap coupled to said neck in a tight relationship;

a one way check valve mounted internally of said bottle cap;

an extractor nozzle extending downwardly from said support housing;

a tube in fluid communication with both said cap and a pump mounted in a fluid chamber in said extractor nozzle;

a trigger assembly mounted to said extractor nozzle having a spring biased trigger pivotally mounted on said trigger assembly engaging said pump, said trigger being pivotable between a first position shutting off fluid flow from said tube and into said fluid chamber, to a second position activating said pump to spray fluid under pressure out of as spray nozzle in fluid communication with said chamber; and a brush assembly mounted to said extractor nozzle spaced from said spray nozzle and extending downwardly for engagement with the surface being cleaned and said pump including a plunger reciprocal within said fluid chamber in fluid tight relationship therein, a one way check valve mounted in said fluid chamber, and a spring disposed between said plunger and said check value normally biasing said plunger upwardly within said fluid chamber.

2. The tool of claim 1 wherein said trigger has a trigger portion abutting against the top of said plunger.

3. The tool of claim 1 wherein said brush assembly includes a brush head mounted to said extractor nozzle having a plurality of spaced bristles.

4. The tool of claim 1 wherein said container is removable from said tool.

5. A wet/dry vacuum cleaner spotter tool comprising;

a fluid containing tank;

an extractor nozzle housing coupled to said tank;

a fluid delivery pump mounted in said nozzle housing;

a tubing fluidly coupled to both said tank and said pump for delivering fluid from said tank to said pump;

a spray nozzle on said nozzle housing coupled to said pump for spraying fluid out of said pump and said pump including a plunger reciprocal within said fluid containing tank in fluid tight relationship therewith, a one way check valve mounted in said fluid containing tank, and a spring disposed between said plunger and said check valve normally biasing said plunger upwardly within said fluid containing tank.

6. The tool of claim 5 wherein said tank is mounted above said nozzle housing for delivering fluid by gravity feed through said tubing.

7. The tool of claim 6 wherein said pump includes fluid pressurizing means therein for pressurizing fluid from said tank and spraying said fluid under pressure out of said spray nozzle.

8. The tool of claim 7 including a brush assembly mounted on said nozzle housing spaced from said spray nozzle including a plurality of spaced downwardly extending bristles for engaging a surface to be cleaned.

9. The tool of claim 8 including a support housing disposed between said tank and said nozzle housing having a vacuum cleaner connection tube for complying said tool to a wet/dry vacuum cleaner.

10. The tool of claim 8 including a spring biased trigger mounted on said nozzle housing having a nozzle portion contacting said pump for selectively delivering fluid from said tubing to said pump and out of said spray nozzle.

* * * * *